US011118319B2

(12) United States Patent
Battjes et al.

(10) Patent No.: US 11,118,319 B2
(45) Date of Patent: Sep. 14, 2021

(54) STRUCTURE IN FLAT-PACKABLE KIT FORM TO PROTECT MAILBOXES FROM SNOWPLOW DAMAGE

(71) Applicants: Thomas Clyde Battjes, Saugatuck, MI (US); Brian Kenneth Erlewein, Fennville, MI (US)

(72) Inventors: Thomas Clyde Battjes, Saugatuck, MI (US); Brian Kenneth Erlewein, Fennville, MI (US)

(73) Assignee: Pine Knot Enterprise, LLC, Saugatuck, MI (US)

( * ) Notice: Subject to any disclaimer, the term of this patent is extended or adjusted under 35 U.S.C. 154(b) by 132 days.

(21) Appl. No.: 16/709,851

(22) Filed: Dec. 10, 2019

(65) Prior Publication Data

US 2021/0172134 A1 Jun. 10, 2021

(51) Int. Cl.
*E01F 7/02* (2006.01)
*A47G 29/122* (2006.01)

(52) U.S. Cl.
CPC ..... *E01F 7/02* (2013.01); *A47G 29/122* (2013.01)

(58) Field of Classification Search
CPC ..... A47G 29/122; A47G 29/1216; A47G 29/1209; A47G 5/00; E01F 7/02; E01F 7/00; E01F 13/02; E04H 1/1244
USPC ..... 232/17, 38, 39; 40/606.06; 404/6; 256/12.5; 135/115; 160/135, 351
See application file for complete search history.

(56) References Cited

U.S. PATENT DOCUMENTS

| | | | | |
|---|---|---|---|---|
| 4,187,978 | A | 2/1980 | Dowker | |
| 4,368,842 | A | 1/1983 | DeLange, III | |
| 4,955,533 | A | 9/1990 | Merkel | |
| 5,411,206 | A | 5/1995 | Latham et al. | |
| 5,460,326 | A | 10/1995 | Albanesius | |
| 6,824,113 | B1 | 11/2004 | Gee et al. | |
| 6,962,460 | B1 | 11/2005 | Pratt | |
| 6,974,073 | B1 | 12/2005 | Snyder | |
| 6,983,876 | B1 | 1/2006 | Hauser | |
| 7,080,773 | B1 | 7/2006 | Tepley | |
| 7,353,985 | B1 | 4/2008 | Weatherholt, II | |
| 7,611,043 | B2 | 11/2009 | Black | |
| 8,794,505 | B1 | 8/2014 | Richardson | |
| 8,925,225 | B2 | 1/2015 | Fiore | |
| 9,549,632 | B2 * | 1/2017 | Pickens | A47G 29/1216 |
| 9,980,593 | B2 | 5/2018 | Pajonas | |
| 10,022,007 | B1 * | 7/2018 | Lucero | G09F 7/18 |
| 10,448,772 | B1 * | 10/2019 | Fiore | E01F 7/00 |
| 2006/0186188 | A1 | 8/2006 | Belanger | |

(Continued)

*Primary Examiner* — William L Miller
(74) *Attorney, Agent, or Firm* — Dunlap Bennett & Ludwig, PLLC

(57) ABSTRACT

A structure in flat-packable kit form to protect mailboxes from snowplow damage is provided. The kit includes four to six flat components that are stackable. Two of the components and foldable so as the be secured to each other, defining a deflection surface extending in generally orthogonal directions from a shared post sleeve. The post sleeve slidably receives a mounting post disposed between the road and a roadside mailbox, where the orthogonally oriented deflection surface blocks plowed or blown snow from impacting and demining the mailbox. The flat-packable kit may include gussets for reinforcing the deflection surface by way of the post sleeve in the assembled condition.

6 Claims, 4 Drawing Sheets

(56) References Cited

U.S. PATENT DOCUMENTS

| | | | | |
|---|---|---|---|---|
| 2008/0314967 | A1* | 12/2008 | Black | A47G 29/1216 232/39 |
| 2010/0243977 | A1 | 9/2010 | Middlebrook, Jr. | |
| 2013/0232834 | A1* | 9/2013 | Fiore | A47G 29/122 40/606.03 |
| 2014/0069996 | A1* | 3/2014 | Pickens | A47G 29/122 232/17 |
| 2017/0156533 | A1* | 6/2017 | Pajonas | A47G 29/1209 |
| 2021/0172134 | A1* | 6/2021 | Battjes | E01F 7/02 |

* cited by examiner

STRUCTURE IN FLAT-PACKABLE KIT FORM TO PROTECT MAILBOXES FROM SNOWPLOW DAMAGE

BACKGROUND OF THE INVENTION

The present invention relates to devices and/or methods for protecting roadside mailboxes and, more particularly, to a structure in flat-packable kit form to protect mailboxes from snowplow damage.

Roadside mailboxes are commonplace in the United States. In rural areas of the United States that see snowfall, such roadside mailboxes can be damaged by the snowplowed snow. Current mailbox protectors are expensive, bulky to ship and transport, not structurally sound, not easy to remove, and inconvenient to store when not in use during the non-winter months.

As can be seen, there is a need for a structure in flat-packable kit form to protect mailboxes from snowplow damage, while being easy to ship, transport, and store. The mailbox protector embodied in the present invention can be purchased as a six-piece kit that assembles easily and slides onto a mounting post between the road and the roadside mailbox. The resulting mailbox protector device is comparatively more structurally sound when deflecting snow from snowplows and inexpensive relative to the prior art, while being easily packaged to sell in stores or ship direct, as well as store during the non-winter months.

SUMMARY OF THE INVENTION

In one aspect of the present invention, a structure in flat-packable kit form for protecting mailboxes from snowplow damage includes the following: a deflection surface having a first leg and a second leg pivotably connected along a surface pivotable connection for moving between a planar condition and a transverse condition; a post bracket having two halves pivotably connected along a bracket pivotable connection for moving between a planar condition and a transverse condition; and a plurality of gussets, each gusset dimensioned to connect either one half of the two halves to the first leg or connect another half of the two halves to the second leg with both the post bracket and deflection surfaces are in their respective transverse conditions, thereby defining a post sleeve between said post bracket and deflection surface, whereby the deflection surface and the post bracket in the flat condition, and the plurality of gussets are stackable in a stack having a thickness of no more than one-half inch, wherein both the bracket and surface pivotable connections include slots, wherein both the bracket and surface pivotable connections are living hinges, wherein the first leg has a first length twenty-five percent to thirty percent that of a second length of the second leg.

In another aspect of the present invention, a method for protecting a roadside mailbox includes the following: securing a mounting post in a ground between the roadside mailbox and an associated road; providing the structure in flat-packable kit form for protecting mailboxes from snowplow damage mentioned above; assembling said structure; sliding the mounting post through the post sleeve; and securing the said structure to the mounting post so that the first leg shields a front of the roadside mailbox and the second leg shields a side of the roadside mailbox facing oncoming traffic along said associated road, wherein the second leg tends to deflect blown, thrown or plowed snow toward a ditch of said associated road.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a structure in flat-packable kit form to protect mailboxes from snowplow damage. The kit includes four to six flat components that are stackable. Two of the components and foldable so as the be secured to each other, defining a deflection surface extending in generally orthogonal directions from a shared post sleeve. The post sleeve slidably receives a mounting post disposed between the road and a roadside mailbox, where the orthogonally oriented deflection surface blocks plowed or blown snow from impacting and demining the mailbox. The flat-packable kit may include gussets for reinforcing the deflection surface by way of the post sleeve in the assembled condition.

It should be understood by those skilled in the art that the use of directional terms such as upper, lower, upward, downwardly, top, left, right and the like are used in relation to the illustrative embodiments as they are depicted in the figures, the upward direction (or upper) being toward the top of the corresponding figures, downward direction being toward the bottom of the corresponding figures.

Figure 1:
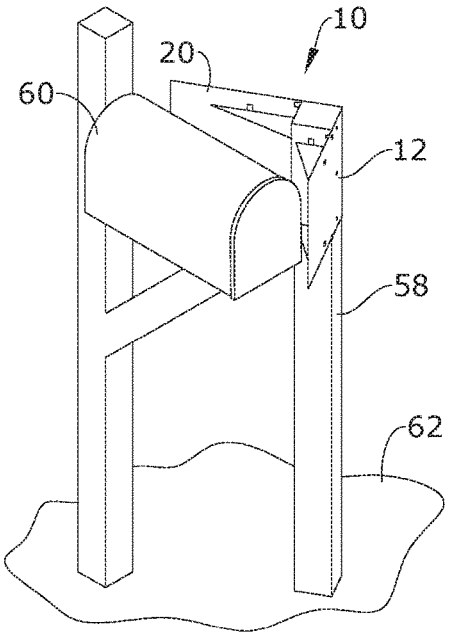
FIG. 1 is a perspective view of an exemplary embodiment of the present invention, shown in use.
Figure 2:
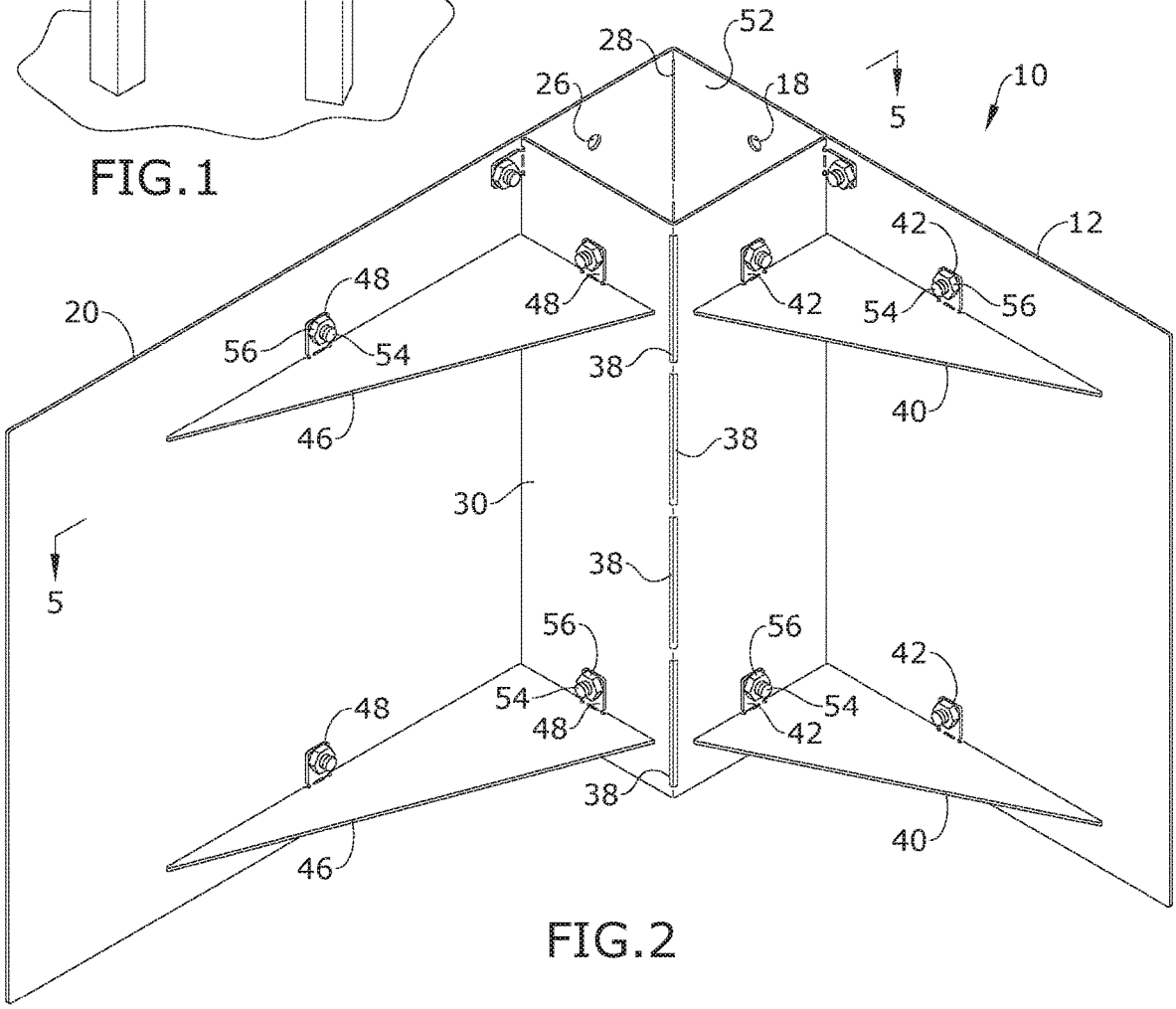
FIG. 2 is an exploded view of an exemplary embodiment of the present invention, illustrating an assembled arrangement.
Figure 3:
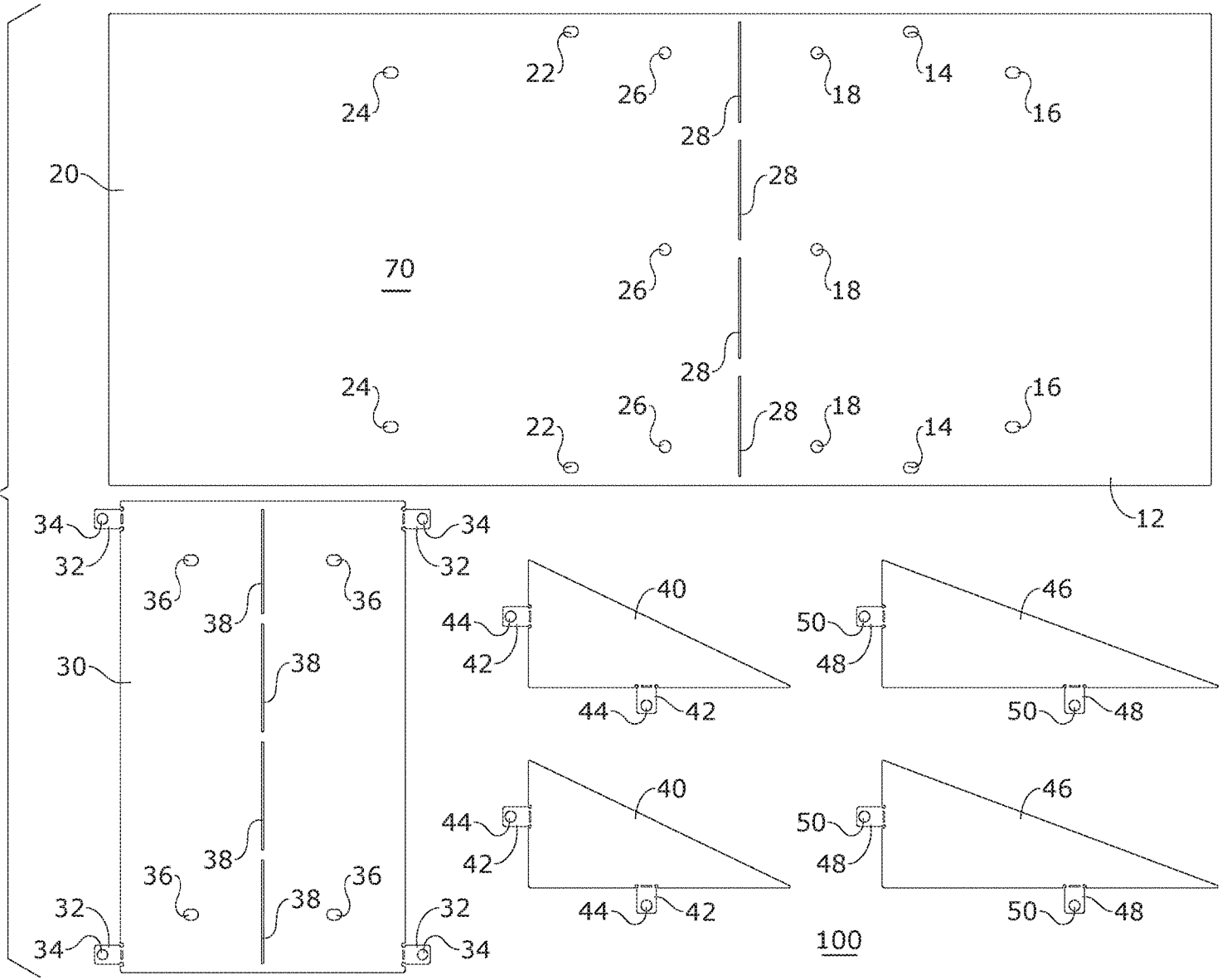
FIG. 3 is a front view of an exemplary embodiment of the present invention, illustrating a pre-assembled arrangement.
Figure 4:
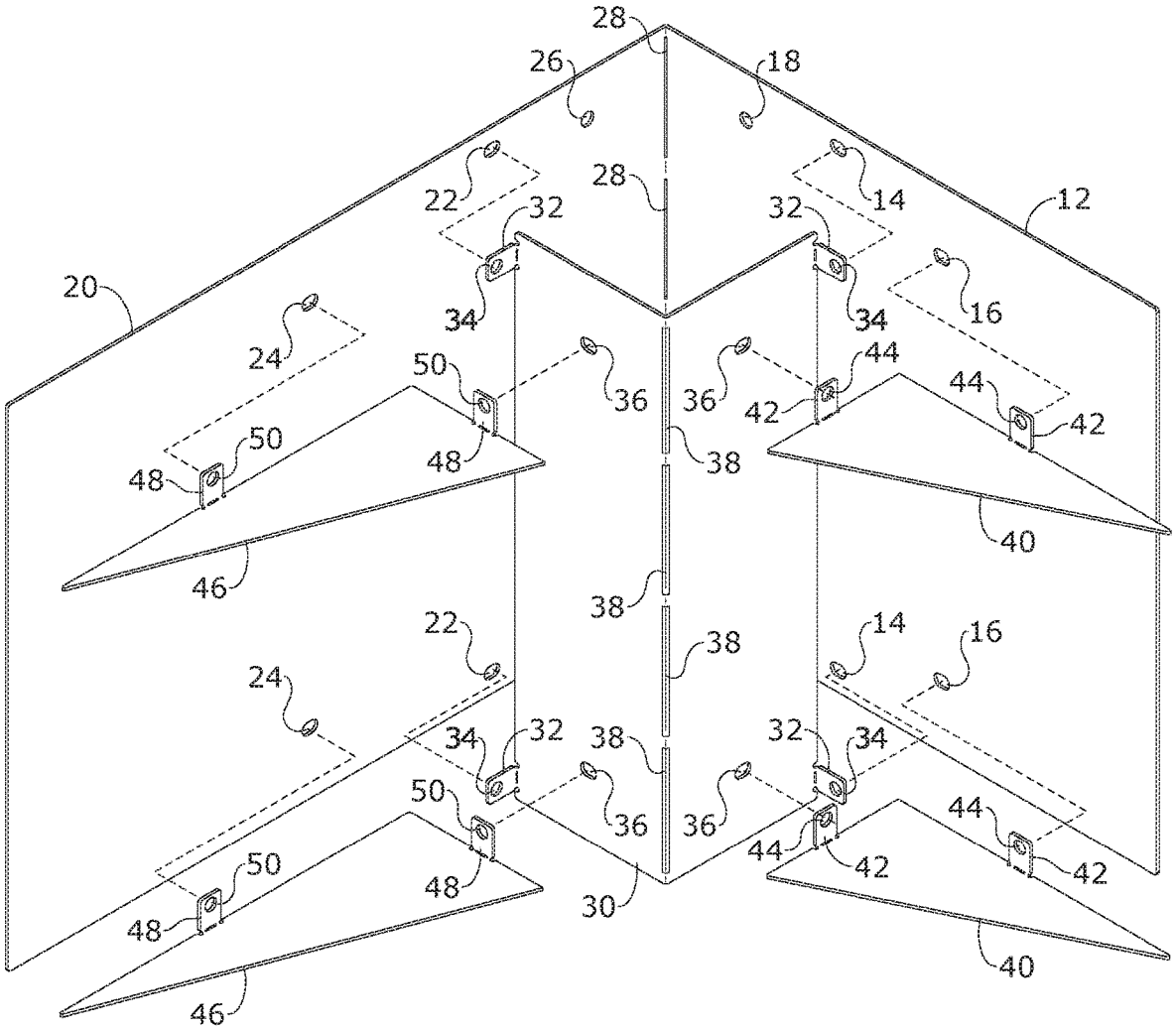
FIG. 4 is an exploded perspective view of an exemplary embodiment of the present invention.
Figures 5, 6:
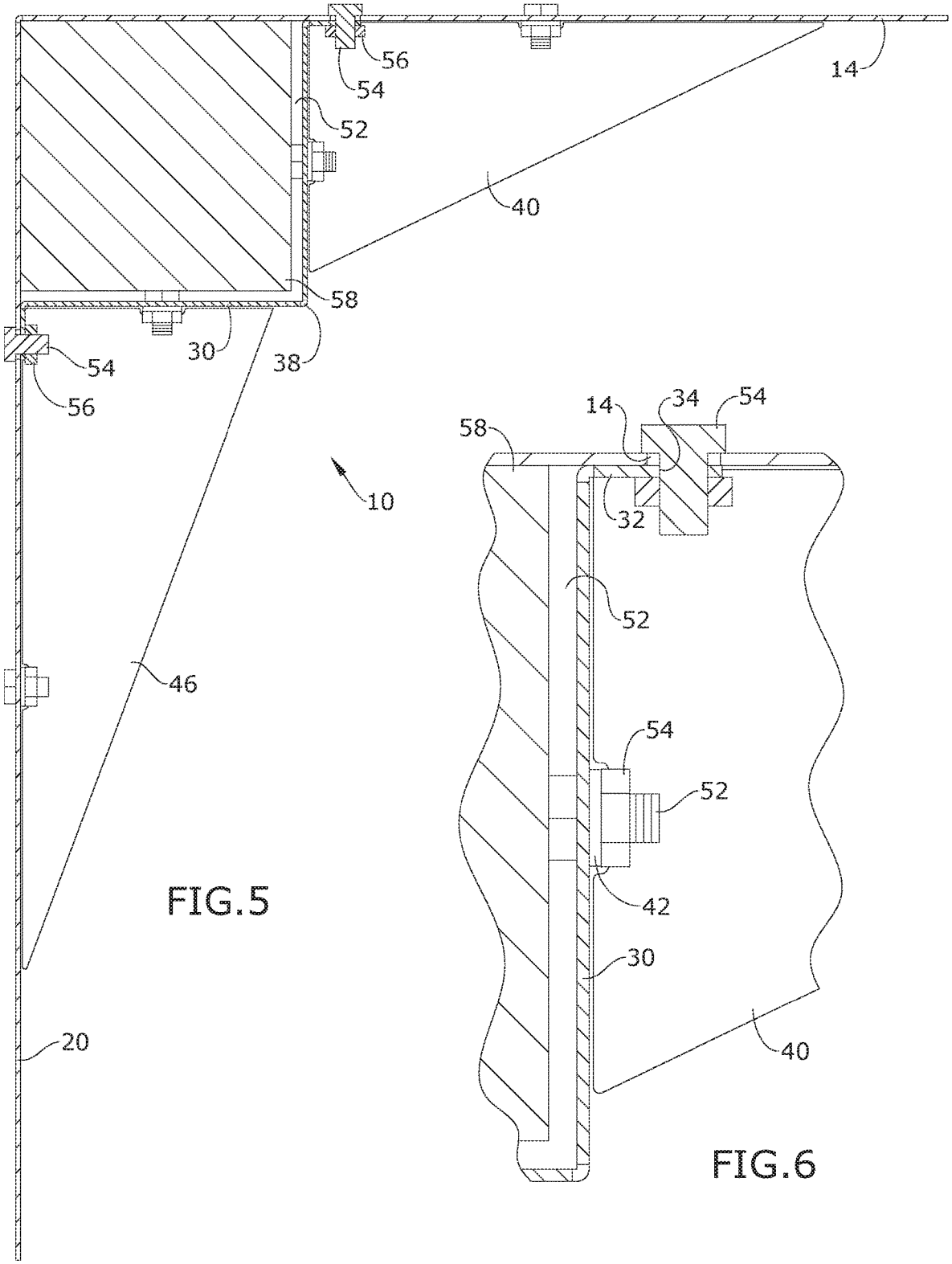
FIG. 5 is a section view of an exemplary embodiment of the present invention, taken along line 5-5 of FIG. 2.
FIG. 6 is a detailed section view of an exemplary embodiment of the present invention.

Referring to FIGS. 1 through 6, the present invention may include a flat-packable mailbox protector kit 10, as illustrated in FIG. 3 in a flat, but spaced-apart condition. It being understood that the flat components of the kit are stackable (not shown) in a flat-packable condition. The flat-packable mailbox protector kit 10 may include a deflection surface 70, a post bracket 30, and a plurality of gussets 40 and 46.

The deflection surface 70 may provide a first leg 12 and second leg 20 pivotably connected by way of a deflection surface pivotable connection 28. The deflection surface pivotable connection 28 may be bending slots cut into the deflection surface 70, living hinges, or the like, as long as they function in accordance with the disclosure herein and further the low-profile flat-packability of the present invention: the deflection surface 70 is moveable between a transverse condition (see FIG. 4) and a flat-packable condition (see FIG. 3). The first leg 12 may have a first length (measured from the deflection surface pivotable connection 28) that is shorter than a second length of the second leg 20 (measured in the opposite direction from the same deflection surface pivotable connection 28). In certain embodiments, the first length may be seven inches, while the second length may be 28 inches. The difference between the first and second lengths helps minimize the overall length of the stackable kit (in flat-pack form), as the first length of the first leg 12 is associated with only the front of the mailbox 60, while the longer second leg 20 guards the longer side of the mailbox 60, deflecting snow toward an adjacent ditch. The first leg 12 (relative) shortness allows thrown snow that would not otherwise hit the front of the mailbox to keep going pass, as opposed to knocking the snow back into the street.

The post bracket 30 may provide a post bracket longitudinal pivotable connection 38 between along two generally equal halves so that the post bracket 30 is moveable between a transverse condition (see FIG. 4) and a flat-packable condition (see FIG. 3). Adjacent to each corner, the post bracket 30 may provide a transversely joined bracket tab 32 having a tab hole 34, so that when the post bracket and the deflection surface 70 are in transverse conditions, the tab holes 34 line up and operatively associate with complementary first and second bracket holes, 14 and 22, respectively, of the deflection surface 70. Whereat appropriate fasteners 54 and 56 may securely engage the complementary tab holes and bracket holes 14 and 22, the post bracket 30 and deflection surface 70 in these secured, transverse conditions—together defining a post sleeve 52 orientation, as illustrated in FIG. 2. The post sleeve 52 is dimensioned and adapted to slidably receive a mounting post 58, to which the deflection surface 70 may attach to via appropriate fasteners.

The plurality of gussets 40 and 46, may include one or more first gussets and one or more second gussets 46. Each gusset, 40/46, may be dimensioned and adapted to operatively associate with either the first or second leg 12/20, respectively, and an adjacent half of the post bracket 30 in the post sleeve orientation. Each gusset, 40/46, provides transversely joined gusset tabs 42/48, respectively, having gusset tab holes 44/50, respectively, for such operative associations. Complementarily, the first and second legs 12/20 may have gusset holes 16/24, and the two halves of the post bracket 30 may have gusset holes so that appropriate fasteners 54 and 56 can attach the gussets 40/46 to the deflection surface 70 and the post bracket 30, as illustrated in the FIGS. The gussets 40/46 provide bending strength and reinforcement to the deflection surface 70.

A method of using the present invention may include the following. The flat-packable mailbox protector kit 10 disclosed above may be provided. A user may assemble the flat-packable mailbox protector kit 10 through forming the post sleeve orientation and using the appropriate fasteners 54 and 65 accordingly. Then the user may dig a small hole in the ground 62 between the roadside mailbox 60 and the road, and secure a mounting post 58 therein. The assembled unit would slide on the mounting post 58 and be screwed into place. When the assembled flat-packable mailbox protector kit 10 is properly placed alongside a mailbox 60 it offers excellent protection from plowed, blown, and/or thrown snow and the transverse orientation of the deflection surface 70 is design to direct a majority of the snow or slush toward along an adjacent ditch (commonly running alongside of the road) as opposed directly back into the road. This is important, because sending the blocked snow or slush back into the road is dangerous for vehicles, difficult for the mailman to deal with, and snow piled in front of the mailbox, which is a problem of its own.

Furthermore, the assembled device embodied in the present invention requires just one mounting post 58 in the ground 62. Many rural people have an extra 4×4 laying around that could be used for this. Additionally, two assembled mailbox protectors could be stacked to protect extra-large mailboxes.

The deflection surface 70, the post bracket 30, and the plurality of gussets and 46 may be 16 gauge steel, and thus six-pieces (wherein the two former components are in the flat condition, and the plurality of gussets total four gussets) are stackable in a stack having a thickness of ½ inch. In such a stack the bracket/gusset tabs 32/42 and 48, respectively may be approximately less than ½ inch in length when transversely extending from the respective component so as to keep said stack within the ½ inch thickness/tolerance.

It should be understood that the present invention may be made and sold as a solid welded version; in other words, the deflection surface 70, the post bracket 30, and the plurality of gussets 40 are a unitary construction without the fasteners disclosed above.

It should be understood, of course, that the foregoing relates to exemplary embodiments of the invention and that modifications may be made without departing from the spirit and scope of the invention as set forth in the following claims.

What is claimed is:

1. A structure in flat-packable kit form for protecting a roadside mailbox from snowplow damage, comprising:

a deflection surface having a first leg and a second leg pivotably connected along a surface pivotable connection for moving between a planar condition and a transverse condition;

a post bracket having two halves pivotably connected along a bracket pivotable connection for moving between a planar condition and a transverse condition; and a plurality of gussets, each gusset dimensioned to connect either one half of the two halves to the first leg or connect another half of the two halves to the second leg with both the post bracket and the deflection surface in their respective transverse conditions, thereby defining a post sleeve between said post bracket and said deflection surface, whereby the deflection surface and the post bracket in the planar condition, and the plurality of gussets, are stackable in a stack having a thickness of no more than one-half inch.

2. The structure in flat-packable kit form for protecting a roadside mailbox from snowplow damage of claim 1, wherein both the bracket pivotable connection and the surface pivotable connection include slots.

3. The structure in flat-packable kit form for protecting a roadside mailbox from snowplow damage of claim 2, wherein both the bracket pivotable connection and the surface pivotable connection are living hinges.

4. The structure in flat-packable kit form for protecting a roadside mailbox from snowplow damage of claim 1, wherein the first leg has a first length twenty-five percent to thirty percent that of a second length of the second leg.

5. The structure in flat-packable kit form for protecting a roadside mailbox from snowplow damage of claim 1, further comprising tabs along the edges of the post bracket, and each gusset provides tabs for connecting the two halves to the first and second legs, and for connecting the plurality of gussets to the two halves and the first and second legs.

6. A method of protecting the roadside mailbox comprising said structure of claim 1, said method comprising:

securing a mounting post in a ground between the roadside mailbox and an associated road;

assembling said structure;

sliding the mounting post through the post sleeve; and securing said structure to the mounting post so that the first leg shields a front of the roadside mailbox and the second leg shields a side of the roadside mailbox facing oncoming traffic along said associated road, wherein the second leg deflects blown, thrown or plowed snow toward a ditch of said associated road.

* * * * *